US012123611B2

(12) United States Patent
Nakajima

(10) Patent No.: US 12,123,611 B2
(45) Date of Patent: Oct. 22, 2024

(54) WIRELESS NETWORK SYSTEM ACCESSIBLE FOR CONTROLLING AIR CONDITIONER

(71) Applicant: DENSO WAVE INCORPORATED, Aichi-pref. (JP)

(72) Inventor: Kensuke Nakajima, Chita-gun (JP)

(73) Assignee: DENSO WAVE INCORPORATED, Aichi-pref. (JP)

( * ) Notice: Subject to any disclaimer, the term of this patent is extended or adjusted under 35 U.S.C. 154(b) by 3 days.

(21) Appl. No.: 17/705,645

(22) Filed: Mar. 28, 2022

(65) Prior Publication Data

US 2023/0304687 A1 Sep. 28, 2023

(51) Int. Cl.
*F24F 11/58* (2018.01)
*F24F 11/65* (2018.01)
*F24F 120/20* (2018.01)

(52) U.S. Cl.
CPC ..... *F24F 11/58* (2018.01); *F24F 11/65* (2018.01); *F24F 2120/20* (2018.01)

(58) Field of Classification Search
None
See application file for complete search history.

(56) References Cited

U.S. PATENT DOCUMENTS

| | | | | |
|---|---|---|---|---|
| 10,598,784 | B2 | 3/2020 | Yang et al. | |
| 2018/0149396 | A1* | 5/2018 | Kawano | B60H 1/00921 |
| 2018/0363936 | A1* | 12/2018 | Inoue | F24F 11/61 |
| 2023/0168652 | A1* | 6/2023 | Ito | G05B 19/042 700/276 |

* cited by examiner

*Primary Examiner* — William G Trost, IV
*Assistant Examiner* — Christopher P Cadorna
(74) *Attorney, Agent, or Firm* — Oliff PLC

(57) ABSTRACT

A wireless network system is incorporated in an air conditioning system. A user is accessible to the wireless network system for controlling the air conditioner. The wireless network system includes an AP (access point) equipment, an air conditioning controller and a user-operable terminal. The terminal and the air conditioning controller are connected communicably and wirelessly when a dedicated application is actuated in the terminal. AP information (such as a password) is transmitted from the terminal to the air conditioning controller to establish coordination (i.e., pairing) between the terminal and the air conditioning controller in a state where the terminal and the air conditioning controller are connected mutually and wirelessly. The AP information identifies the AP equipment. In this coordinated state, the access to the AP equipment is executed based on the AP information. Authentication is performed when the terminal and the air conditioning controller are mutually and directly connected.

8 Claims, 7 Drawing Sheets

WIRELESS NETWORK SYSTEM ACCESSIBLE FOR CONTROLLING AIR CONDITIONER

BACKGROUND

Technical Field

The present disclosure relates to a wireless network system for controlling air conditioners, and in particular, to a wireless network system that users can access when controlling air conditioners using their own terminals.

Related Art

Conventionally, air conditioners, one of home appliances, are mostly controlled wirelessly by the user from an air conditioner controller installed in the air conditioner itself or a terminal (e.g., smartphone) owned by the user to start/stop its operation and set/change operating conditions.

Examples of this wireless control, or remote air conditioning control, can be found, for example, in Patent Document 1.

This Patent Document 1 illustrates a network connection system for home appliances in one of its forms. According to this system, the system includes at least one terminal, a server device, an access point (AP) equipment, and at least one consumer electronics device. Terminals, server devices, and the AP equipment sends and receives data to and from each other via wired/wireless communication networks. For example, the server device and the AP equipment can send and receive data to and from each other via a wired communication network. The terminals and AP equipment can send and receive data from each other via wireless communication networks.

In this communication environment, the terminal receives an authentication key input from the AP equipment, and the terminal or AP equipment verifies and authenticates the authentication key. This sets up the home appliance devices to be interconnected and ready to communicate with the terminal. Furthermore, the identification number and authentication key of the AP equipment are sent from the terminal to the home appliance. The home appliance is connected to the access point device based on the identification number and authentication key.

As a result, users can remotely operate home appliances, such as air conditioners, using a terminal such as a smartphone. In other words, a dedicated application provided by the manufacturer, etc., is installed on the terminal and the dedicated application is activated on the terminal. This connects the terminal and the air conditioning controller of the air conditioner to each other via the AP equipment. This allows remote control of home appliances such as air conditioners from the terminal.

Here, taking the example of an air conditioner as an appliance, in the case of the network connection method described above, linking the air conditioner controller to a terminal (e.g., smartphone) still requires a large amount of manual input process by the user. Specifically, the network name (SSID) of the AP equipment must be selected from the login screen of the air conditioning controller, and then the password (security key) must be manually entered. Since this manual input is naturally done by hand, it is tedious, prone to input errors, and often requires re-entry.

CITATION LIST

Patent Literature

[PTL 1] U.S. Pat. No. 10,598,784 B2

SUMMARY

In view of the above circumstances, when a user's terminal is connected to an air conditioning controller for drive control of an air conditioner, manual input by the user is still required, and a simpler coordination method is desired from the viewpoint of time and effort.

According to an exemplary example of the present disclosure, there is provided a wireless network system that is incorporated into an air conditioning control system that controls an air conditioning unit and is accessible by the user for control of the air conditioning unit. The system has an AP (access point) equipment capable of wireless communication and a dedicated application for controlling the drive of the air conditioner, and it is equipped with an air conditioning controller that controls the drive of the air conditioner via a dedicated communication cable, and a terminal in which the dedicated application is installed and the user can manually operate the dedicated application. Furthermore, when the dedicated application is started in the terminal, the system has connection means that allow the terminal and the air conditioning controller to be connected wirelessly and mutually communicative, and AP information that identifies the AP equipment (such as a password that identifies the AP equipment) to be transmitted from the terminal to the air conditioning controller when the terminal and the air conditioning controller are mutually connected by the connection means. The system also is equipped with coordination means that coordinates the terminal to the air conditioning controller concerned, and access execution means that cause the air conditioning controller to execute access with the AP equipment based on the AP information. The connection means is equipped with authentication means to perform authentication of direct connection between the terminal and the air conditioning controller.

As an example, the authentication method is configured to establish authentication between the terminal and the air conditioning controller based on a one-time password issued by the air conditioning controller.

As another example, the authentication method is configured to establish authentication between the terminal and the air conditioning controller based on Near Field Communication (NFC) communication activated in the air conditioning controller.

As an alternative to the basic configuration of the aforementioned example, there is also provided a method of accessing a wireless network system for control of the air conditioner by the user. According to this access method, when the dedicated application is started at the terminal, the terminal and the air conditioning controller are connected wirelessly to each other for mutual communication, and AP information identifying the AP equipment is transmitted from the terminal to the air conditioning controller when the terminal and the air conditioning controller are connected to each other. The terminal is linked directly and mutually authenticated to the air conditioning controller concerned, and the air conditioning controller is made to perform access to the AP equipment based on the AP information. According to the wireless network system and access method for the above configuration, when a dedicated application is started on a terminal, the terminals are directly interconnected and linked to the air conditioning controller so that they can communicate wirelessly. This coordination uses a one-time password issued by the air conditioning controller and NFC communication between the air conditioning controller and the terminal. This eliminates the need to manually select the network name of the AP equipment from the login screen of the air conditioning controller and manually enter the password in order to link the air conditioning controller and the terminal. Simply manipulating a one-time password or activating NFC communication is all that is required, reducing the effort associated with manual input and the errors associated with such input.

Other configurations and effects other than those described above will become clear in the examples described below with the drawings.

BRIEF DESCRIPTIONS OF THE DRAWINGS

DESCRIPTION OF PREFERRED EMBODIMENTS

The following describes various examples of wireless network systems that are installed in air conditioning control systems that control air conditioners often used in homes and other places, and that users can access to control air conditioners, with reference to the drawings.

First Embodiment

Referring to FIGS. 1 through 5, the first example of a wireless network system that can be accessed by users to control air conditioning units is described. Through this process in the wireless network system, the access method for control of the user's air conditioner is also implemented in accordance with this disclosure.

Figure 1:
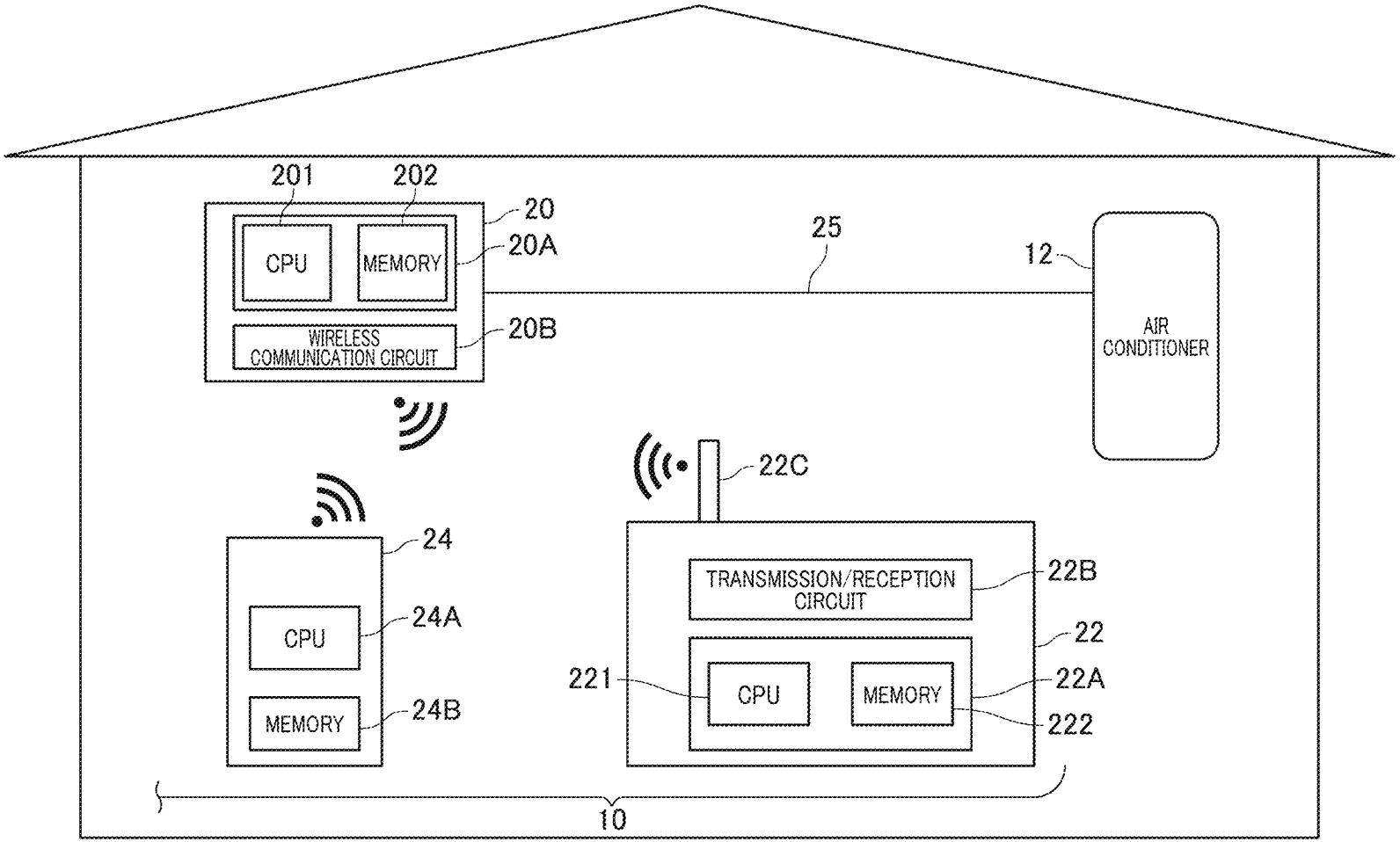
FIG. 1 is a block diagram illustrating the components of a wireless network system for air conditioning control, for the first example.

A wireless network system 10 is equipped to wirelessly control the drive of an air conditioner 12 or general household use, as shown schematically in FIG. 1. The wireless network system 10 includes an air conditioning controller 20 connected to the air conditioner 12 via a dedicated communication cable 25, an AP (access point) equipment 22 that functions as a wireless base station, and a terminal (e.g., smartphone) 24 owned by the user.

A dedicated "coordination application (i.e., dedicated application)" to the air conditioning is downloaded and installed on the terminal 24 to control the drive of the air conditioner 12 in conjunction with the air conditioning controller 20. This coordination application is provided by the manufacturer of the air conditioner and others.

This terminal 24 is provided as a multifunctional cell phone that combines the functions of a personal computer and has a high affinity with the Internet, e.g., as a smartphone. For this purpose, the system is equipped with a CPU 24A and a memory 24B. Thus, the CPU 24A can interactively launch the dedicated coordination application with the user that has been downloaded or otherwise stored in the memory 24B. A menu for this activation can be displayed on that screen.

The terminal 24 is not necessarily a smartphone, but can be a portable tablet, PC, or even a smartwatch.

The air conditioning controller 20 has a microcontroller 20A and a wireless communication circuit 20B, and the microcontroller 20A has a CPU 201 and various memories 202. The air conditioning controller 20 has an AP (access point) mode and is configured by the CPU 201 to display a user-operable AP mode button (see FIG. 4) on its screen. Thus, when the user touches its AP mode button, the air conditioning controller 20 can communicate with the terminal 24.

Figure 2:
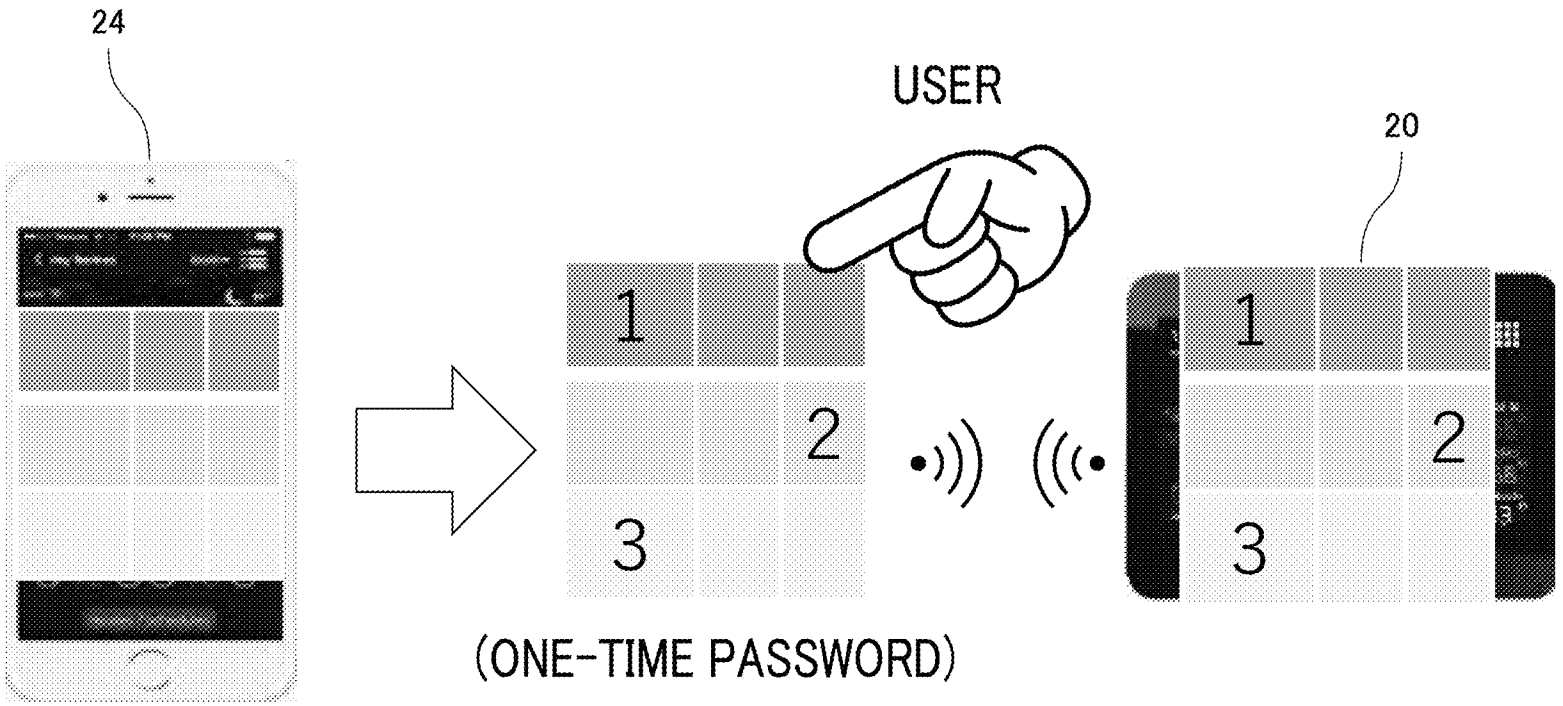
FIG. 2 illustrates the authentication using a one-time password between the terminal and the air conditioning controller in the first example.

Furthermore, with the terminal 24 and the air conditioning controller 20 connected to each other wirelessly, the coordination application can run on the terminal 24 to mutually authenticate each other. In this example, a one-time password is used as this authentication method. For this purpose, the air conditioning controller 20 is configured by its CPU 201 to issue a one-time password that can be used temporarily and displayed on the screen, as illustrated in FIG. 2. This screen is shared between the air conditioning controller 20 and the terminal 24. Therefore, the user enters this one-time password on the screen of the terminal 24. Once this one-time password is authenticated by the CPU 201 of the air conditioning controller 20, the terminal 24 and the air conditioning controller 20 are interconnected and can work together (see FIG. 3). At this time, even if there is a radio signal from another terminal 24X, the air conditioning controller 20 will not respond, thus preventing a false connection, and the terminal 24 and the air conditioning controller 20 will remain securely linked, once interconnected (see FIG. 5).

One-time passwords can be input in a variety of ways, including number input, QR code (registered trademark) input, pattern input, and cell push-down input. FIG. 2 shows a schematic example of number entry. According to this example, cells with numbers in three of the 3×3 squares are displayed on the screen of the air conditioning controller 20. Therefore, the user presses each cell in turn on the screen of the terminal 24 according to the cell whose number appears on the controller screen. This establishes a direct pairing, or coordination, between the two.

The AP equipment (or device) 22 is provided as a conventionally known WiFi device and functions as a base station for mutual wireless communication with the terminal 24 and the air conditioning controller 20. The air conditioning controller 20 and the air conditioner 12 are connected via the cable 25 and communicate with each other by wire.

This AP equipment (device) 22 has a microcontroller circuit 22A (with a CPU 221 and a memory 222), a wireless and wired transmitter/receiver circuit 22B, and a transmitter/ receiver antenna 22C. The AP equipment 22 has two modes of operation in this example: router mode and WiFi direct mode, but the WiFi device is operated in WiFi direct mode.

Figure 3:
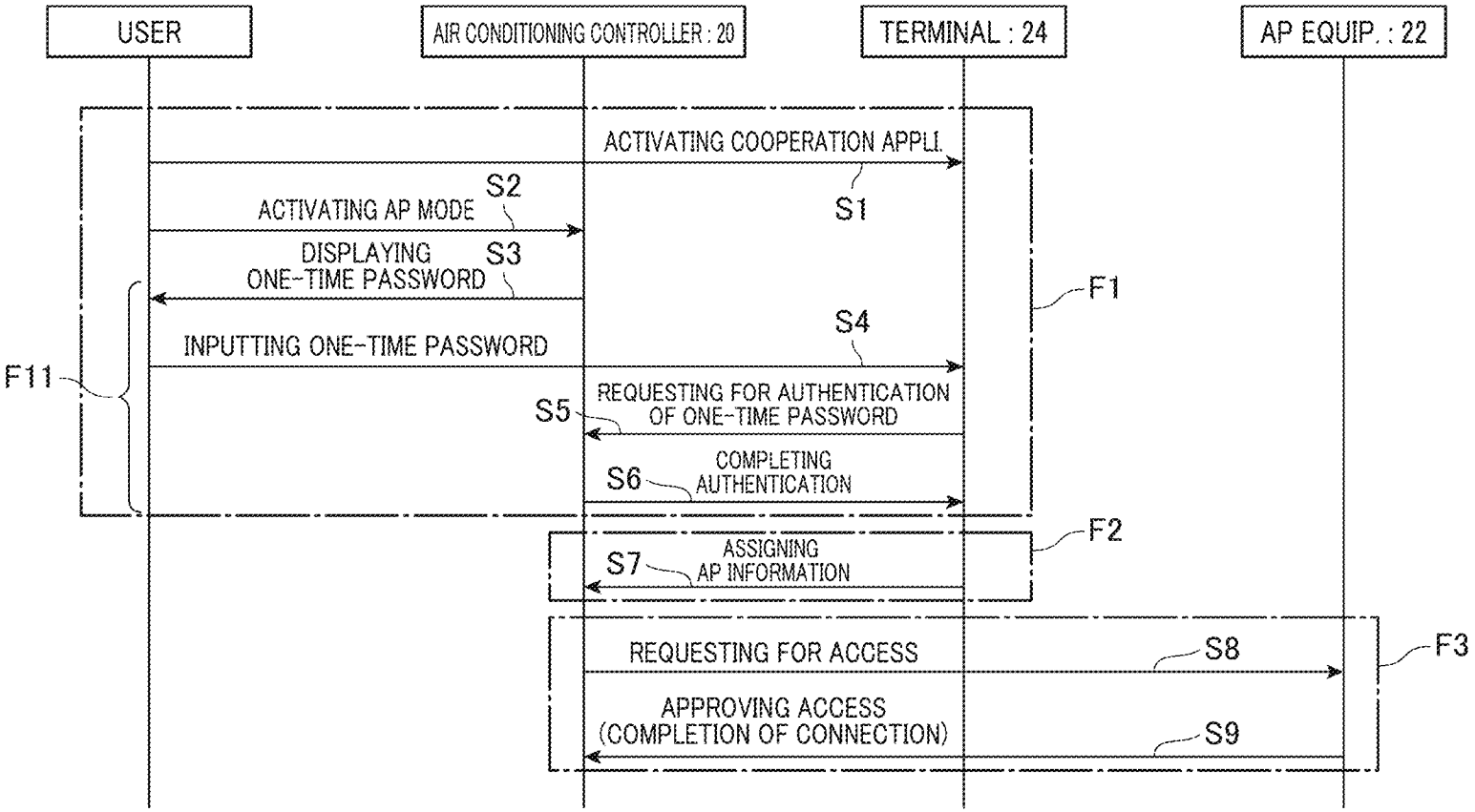
FIG. 3 shows a sequence diagram outlining the steps that are performed interactive with the user in the first example, in which the terminal, the air conditioning controller, and the AP equipment each cooperate with each other.
Figure 4:
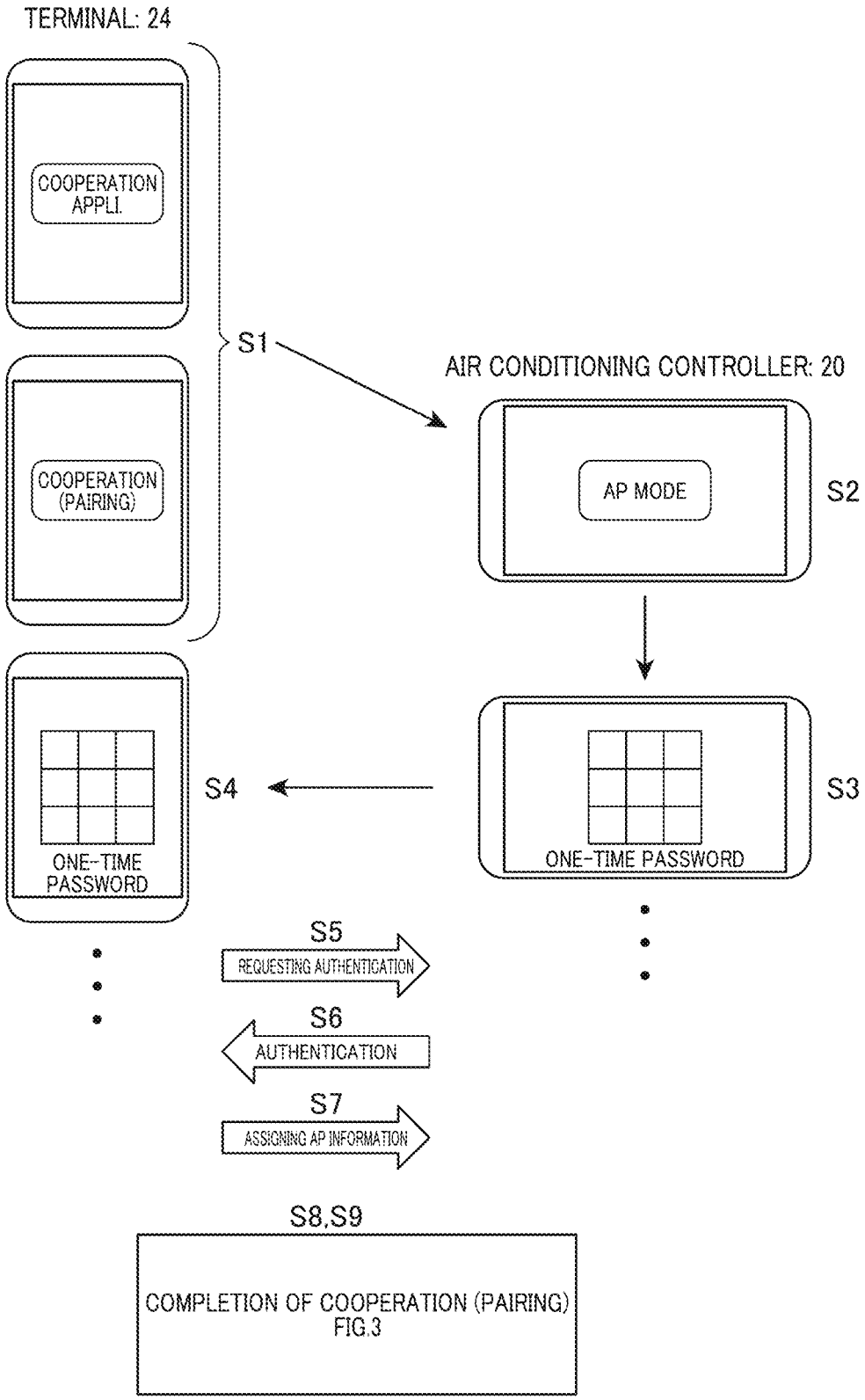
FIG. 4 is a supplemental illustration of the sequence in FIG. 3.

Next, the sequence diagram shown in FIG. 3 and the supplementary illustration shown in FIG. 4 describe the overall operation of the wireless network system that the user can access to control the air conditioner.

The operations described below are actually performed by CPUs 24A, 201, and 221, which are the computing functions possessed by each of the terminal 24, air conditioning controller 20, and AP equipment 22. However, from an explanatory standpoint, it is easier to understand the components 24, 20, and 22 as blocks, so the detailed processing of the CPU is omitted from the description. The same is true for each element's memory 24B, 202, 222.

First, the user launches a dedicated coordination application that he or she owns, such as downloading it to his or her terminal 24, such as a smartphone, from its input screen (FIGS. 3 and 4, Step S1). This activation causes the terminal 24 and the air conditioning controller 20 to be connected wirelessly to each other, and the input screen of the terminal 24 displays a screen prompting the user to pair (i.e., coordination or linkage) the terminal 24 with the air conditioning controller 20.

Then, the user activates the AP mode from the input screen of the air conditioning controller 20 (step S2). This allows the air conditioning controller 20 to recognize that it is planning to control air conditioning via the AP equipment 22.

Therefore, the air conditioning controller 20 displays the one-time password and presents it to the user (step S3), as shown in FIG. 2. In response, the user enters the one-time password presented to him or her into the one-time password screen of the terminal 24 (step S4).

In response, the terminal 24 requests the air conditioning controller 20 to authenticate the entered one-time password (step S5). The air conditioning controller 20 performs its authentication process, and the air conditioning controller 20 notifies the user that authentication is complete (step S6). Of course, there are cases where authentication is not possible, in which case the reason for non-authentication is sent to the terminal 24.

The above authentication completion (pairing completion) means that a link capable of secure wireless communication has been established between the air conditioning controller 20 and the terminal 24. In other words, this allows the terminal 24 and the air conditioning controller 20 to be wirelessly connected to each other.

Therefore, the terminal 24 transfers to the air conditioning controller 20 the access point (AP) information of the AP equipment 22 known to the user (step S7). This AP information is, for example, a password that identifies the AP equipment 22. Of course, the AP information for this transfer may be given manually by the user or by a pull-down menu method.

In response to this transfer, the air conditioning controller 20 issues a request for communication access to the AP equipment 22 indicated by its access point information (step S8). In response, the AP equipment 22 sends back a reply to the air conditioning controller 20 to approve access (step S9), and the air conditioning controller 20 in conjunction with the terminal 24 is wirelessly connected to the AP equipment 22. Of course, if the wrong AP information is transferred, the above coordination will not be achieved.

Figure 5:
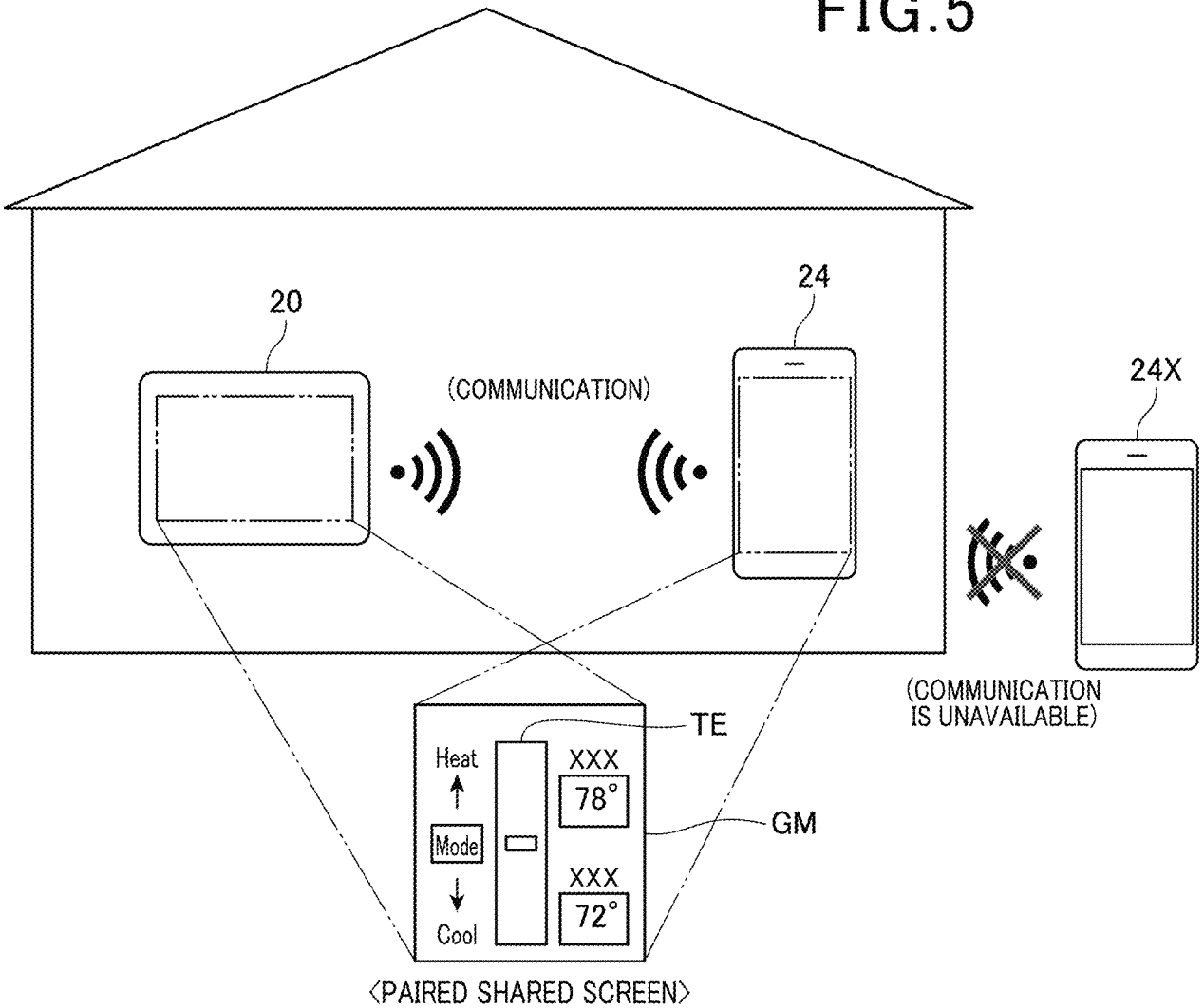
FIG. 5 illustrates the established coordination state (pairing) between the terminal and the air conditioning controller, which is established in the first example.

As a result of the above access authentication, the terminal 24 can control the drive of the air conditioner 12 via the AP equipment 22 and the air conditioning controller 20. FIG. 5 shows an example of the screens of the air conditioning controller 20 and terminal 24 in a cooperative state (pairing completed). For this reason, a common temperature setting screen GM is displayed on the air conditioning controller 20 and terminal 24, as shown in FIG. 5.

In this example, the coordination application runs on terminal 24, and when the temperature setting line TE on the temperature setting screen GM of terminal 24 is manually operated through such linking (pairing), the operation information (air conditioning start or air conditioning status change) is transmitted to air conditioner 12 via AP equipment 22 and air conditioning controller 20. This allows the room temperature to be controlled by the heating and cooling functions of the air conditioner 12. Of course, the air conditioner 12 can be controlled in the same way from the temperature setting screen GM of any of the air conditioning controller 20 and terminal 24. In this control, the operation signals are sent to the air conditioner 12 under the so-called after-win process, so that the operation signals issued later among the operation signals from the air conditioning controller 20 and terminal 24 become valid signals.

With the connection between the air conditioning controller 20 and the AP equipment 22 completed, the user can command the desired air conditioning conditions from the menu screen displayed on the screen of his terminal 24.

In this example, the transferred AP information and information indicating access approval (steps S7, S9) are retained in the memory 202 of the air conditioning controller 20. Therefore, unless the AP information changes due to the user buying a new AP equipment, for example, there is no need to perform the authentication process again. In other words, it is not necessary to enter a one-time password every time the air conditioner 12 is used. This input immediately links the terminal 24 to the air conditioning controller 20, allowing the terminal 24 to control the drive of the air conditioner 12 via the AP equipment 22.

Thus, the connection between the air conditioning controller 20 and the AP equipment 22 is facilitated. In other words, the user only needs to follow the numbers displayed on the screen of the air conditioning controller 20, so there is no need to select the SSID, rely on memory to enter the password, etc., as in the past. Also, there is no need to manually enter authentication information such as SSID and password into the air conditioning controller 20, as in the past.

The sequence processes shown in FIG. 3, which are functionally executed by the air conditioning controller 20, terminal 24, and AP equipment 22 in response to activation of the coordination application, constitute the various functional means. First, steps S1-S6 functionally constitute connection means F1. Of these connection means, steps S3-S6 correspond to authentication means F11. Furthermore, step S7 functionally constitutes coordination means F2, and steps S8 and S9 functionally constitute access execution means F3.

Second Embodiment

Figure 6:
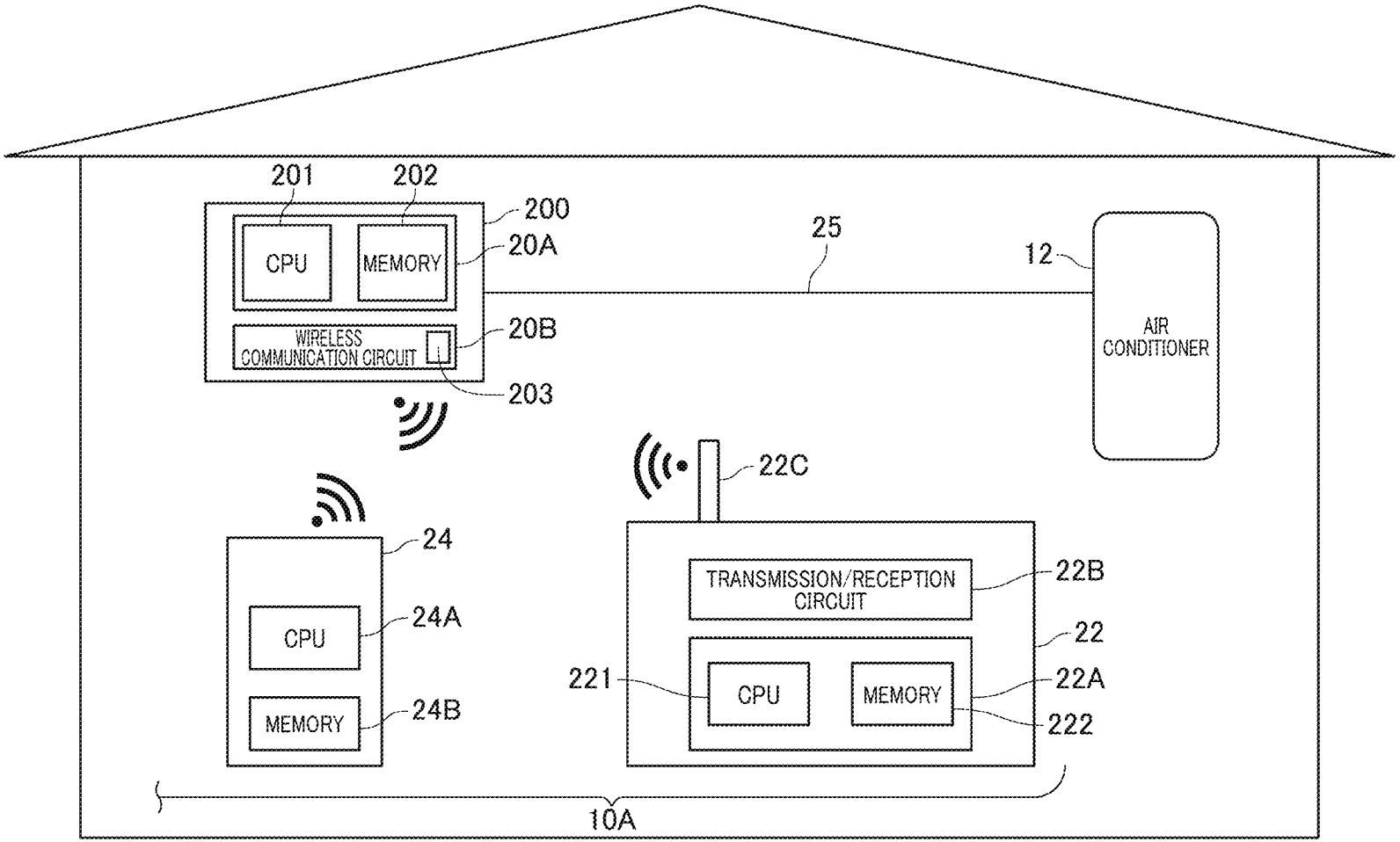
FIG. 6 is a block diagram illustrating the components of a wireless network system for air conditioning control, for the second example.
Figure 7:
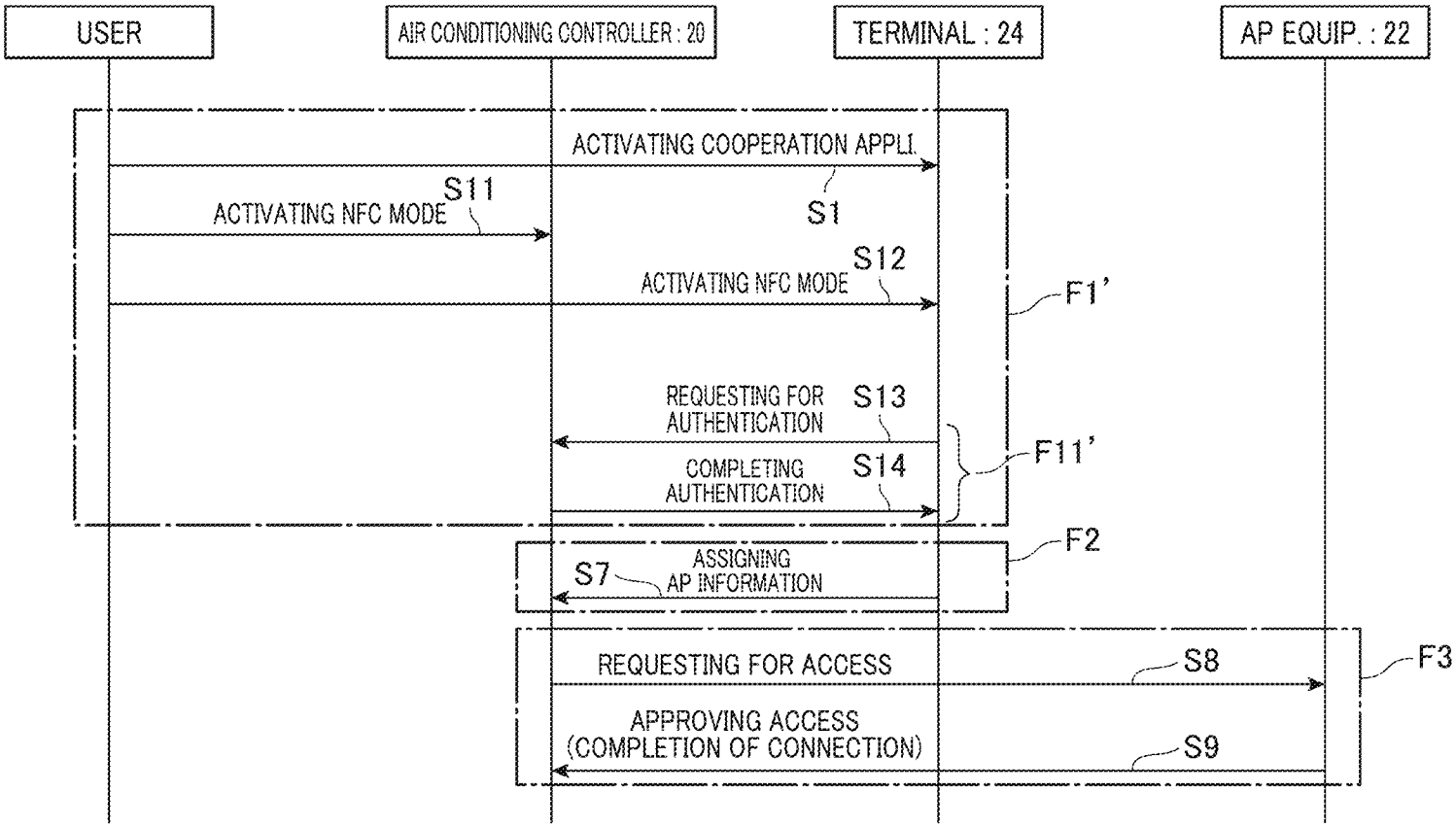
FIG. 7 shows a sequence diagram outlining the steps that are performed interactively with the user in the second example, in which the terminal, the air conditioning controller, and the AP equipment each cooperate with each other.

Referring to FIGS. 6 through 7, the second example of a wireless network system that users can access to control air conditioners is described.

In this example, components that are identical or equivalent to the components of the wireless network system described in the first example above are marked with the same symbol, and their descriptions are omitted or simplified.

The wireless network system 10A for this second example has an air conditioning controller 200, as shown in FIG. 6. This air conditioning controller 200 has the microcontroller 20A and the wireless communication circuit 20B, as described above, and the microcontroller 20A has the CPU 201 and various memories 202. This wireless communication circuit 20B is configured to allow a Near Field Communication (NFC) tag 203 to be mounted to enable short-range communication with the terminal 24.

Note that smartphones and other terminals are equipped with NFC read-writers.

This second example of the wireless network system 10A therefore operates as shown in the sequence in FIG. 7.

For this purpose, the user launches the already saved coordination application dedicated to accessing the air conditioner 12 from the menu screen of the terminal 24 (FIG. 7, step S1). Next, the user selects NFC mode on the menu screen of the air conditioning controller 200 to activate it (step S11). This activates the wireless communication circuit 20B with the NFC tag 203. Authentication information indicating the terminal 24 is written to this NFC tag 203 in advance. The user then selects NFC mode from the menu screen of terminal 24 to activate it (step S12). This activates the NFC read-writer equipped in the terminal 24, and the terminal 24 and the air conditioning controller 200 are connected to each other for short-range communication.

Next, an authentication request is issued from the terminal 24 to the air conditioning controller 200 (step S13), and if the air conditioning controller 200 can authenticate it, a notification to that effect (authentication completion notification) is sent back from the air conditioning controller 200 to the terminal 24 (step S14). This completes the state in which the user can issue commands to control the drive of the air conditioner 12 via the AP equipment 22 from the air conditioning control screen of either the terminal 24 or the air conditioning controller 200, which are interconnected under AP mode. This command is issued under a process called after-win processing, in which the command of the later operated of the terminal 24 or the air conditioning controller 200 becomes effective.

The sequence process shown in FIG. 7, which is functionally executed by the air conditioning controller 200, terminal 24, and AP equipment 22 upon startup of the coordination application, constitutes the various functional means. First, steps S1 and S11-S14 functionally constitute connection means F1'. Steps S12 and S13 of this connection method correspond to authentication means F11'. Furthermore, as in the first example, step S7 functionally constitutes coordination means F2, and steps S8 and S9 functionally constitute access execution means F3.

The user thus obtains the same effect as in the first example described above. In particular, it is only necessary to write the unique information of the terminal side to the NFC tag 203 once, and after that, all that is required is to launch the dedicated coordination application. This eliminates the need for the user to manually enter passwords and other information when using the air conditioner, significantly reducing the operational effort for the user. Moreover, the unit price of the NFC tag 203 is usually low, so even if it is mounted on the air conditioning controller 200, a large increase in the manufacturing cost of the air conditioning controller 200 can be avoided.

Of course, even if another device with NFC communication capability is nearby, the terminal 24 and the air conditioning controller 200, which are already authenticated and directly linked with each other, will not be affected.

The above-described embodiments are not limited to the embodiments described above and in the figures, but can be modified as appropriate to the extent not to depart from the gist of the invention.

What is claimed is:

1. A wireless network system incorporated in an air conditioning control system that controls an air conditioner, a user being allowed accessible to the air conditioning control system to control the air conditioner, the wireless network system comprising:

access point (AP) equipment comprising a first processor, the AP equipment performing wireless communication based on processing of the first processor;

an air conditioning controller comprising a second processor and a memory, the air conditioning controller being configured to operate based on a dedicated application for controlling drive of the air conditioner connected to the air conditioner via a dedicated communication cable, and configured to perform wireless communication based on processing of the second processor; and a terminal comprising a third processor, the dedicated application being installed in the terminal, a user enabling the dedicated application to be operated manually at the terminal, the terminal performing wireless communication based on processing of the third processor, wherein in response to commands from the user at the terminal, when the dedicated application has been downloaded to the terminal and is actuated in the terminal, the third processor of the terminal and the second processor of the air conditioning controller are configured to connect the terminal and the air conditioning controller communicably and wirelessly by a wireless communication connection, the third processor of the terminal is configured to transmit AP information from the terminal to the second processor of the air conditioning controller in a state where the terminal and the air conditioning controller are mutually and wirelessly connected to each other, the AP information being known by a user and previously assigned to the AP equipment to identify the AP equipment and being unrelated to identification of the terminal, the transmitted AP information being stored in the memory for a next drive of the air conditioner, when coordination between the terminal and the air conditioning controller has been established, the second processor of the air conditioning controller is configured to request for access to the first processor of the AP equipment for approval of the access, the first processor of the AP equipment is configured to reply approval information to the second processor of the air conditioning controller, the approval information showing the approval of the access is stored in the memory for the next drive of the air conditioner, the terminal and the air conditioning controller being mutually coordinated and wirelessly connected to the AP equipment, and the third processor of the terminal is configured to obtain authentication of direct connection between the terminal and the air conditioning controller when the wireless communication connection is established between the terminal and the air conditioning controller.

2. The wireless network system according to claim 1, wherein the third processor of the terminal is configured to establish the authentication of the direct connection between the terminal and the air conditioning controller, based on a one-time password issued by the second processor of the air conditioning controller, when obtaining the authentication of the direct connection.

3. The wireless network system according to claim 1, wherein the third processor of the terminal is configured to establish the authentication of the direct connection between the terminal and the air conditioning controller, through Near Field Communication (NFC) activated by the second processor of the air conditioning controller.

4. An access method performed in a wireless network system incorporated in an air conditioning system for controlling an air conditioner, the wireless network system comprising:

access point (AP) equipment comprising a first processor, the AP equipment performing wireless communication based on processing of the first processor;

an air conditioning controller comprising a second processor and a memory, configured to operate based on a dedicated application for controlling drive of the air conditioner connected to the air conditioner via a dedicated communication cable, and configured to perform wireless communication based on processing of the second processor; and a terminal comprising a third processor, the dedicated application being installed in the terminal, a user enabling the dedicated application to be operated manually at the terminal, the terminal performing wireless communication based on processing of the third processor, the method comprising:

in response to commands from the user at the terminal, when the dedicated application has been downloaded to the terminal and is actuated in the terminal, operating the third processor of the terminal and the second processor of the air conditioning controller to connect the terminal and the air conditioning controller communicably and wirelessly;

operating the third processor of the terminal to transmit AP information from the terminal to the second processor of the air conditioning controller in a state where the terminal and the air conditioning controller are mutually and wirelessly connected to each other by a wireless communication connection, the AP information being known by a user and previously assigned to the AP equipment to identify the AP equipment and being unrelated to identification of the terminal, and the transmitted AP information being stored in the air conditioning controller for a next drive of the air conditioner;

when coordination between the terminal and the air conditioning controller has been established, operating the second processor of the air conditioning controller to request access to the first processor of the AP equipment for approval of the access;

operating the first processor of the AP equipment to reply approval information to the second processor of the air conditioning controller, the approval information showing the approval of the access is stored in the memory for the next drive of the air conditioner, the terminal and the air conditioning controller being mutually coordinated and wirelessly connected to the AP equipment; and enabling the third processor of the terminal to obtain authentication of direct connection between the terminal and the air conditioning controller when the wireless communication connection is established between the terminal and the air conditioning controller.

5. The access method according to claim 4, wherein when obtaining the authentication, the third processor of the terminal establishes the authentication of the direct connection between the terminal and the air conditioning controller, based on a one-time password issued by the second processor of the air conditioning controller.

6. The access method according to claim 4, wherein when obtaining the authentication, the third processor of the terminal establishes the authentication of the direct connection between the terminal and the air conditioning controller, through Near Field Communication (NFC) activated in the second processor of the air conditioning controller.

7. The wireless network system according to claim 1, wherein the third processor of the terminal and the second processor of the air conditioning controller are configured to present a temperature setting screen which are common to both the terminal and the air conditioning controller, such that the user is allowed to control a temperature of the air conditioner on the temperature setting screen of the terminal.

8. The wireless network system according to claim 7, wherein when the temperature setting screens of the terminal and the air conditioning controller are operated, signals showing operations at the temperature setting screens of the terminal and the air conditioning controller are processed in an after-win process and an operation signal is sent to the air conditioner.

* * * * *